United States Patent [19]

de Jong

[11] 4,280,256

[45] Jul. 28, 1981

[54] FASTENER APPARATUS

[75] Inventor: Hendrik J. de Jong, Groenlo, Netherlands

[73] Assignee: N.V. Nederlandsche Apparatenfabriek NEDAP, Groenlo, Netherlands

[21] Appl. No.: 343

[22] Filed: Jan. 2, 1979

[30] Foreign Application Priority Data

Jan. 3, 1978 [GB] United Kingdom ..... 55/78

[51] Int. Cl.[3] ..... A44B 9/00

[52] U.S. Cl. ..... 24/155 BR; 24/110

[58] Field of Search ..... 24/155 BR, 150 R, 150 P, 24/211 N, 211 L, 108, 110

[56] References Cited

U.S. PATENT DOCUMENTS

| | | | |
|---|---|---|---|
| 571,792 | 11/1896 | Quinby | 24/155 BR |
| 1,014,176 | 1/1912 | Rasmussen | 24/155 BR |
| 3,261,067 | 7/1966 | Ikeda | 24/155 BR |
| 3,858,280 | 1/1975 | Martens | 24/155 BR |
| 3,971,269 | 7/1976 | Martens . | |

FOREIGN PATENT DOCUMENTS

| | | |
|---|---|---|
| 651556 | 4/1951 | United Kingdom . |
| 731884 | 6/1955 | United Kingdom . |
| 877279 | 9/1961 | United Kingdom . |
| 1524546 | 9/1978 | United Kingdom . |

*Primary Examiner*—Kenneth Downey
*Attorney, Agent, or Firm*—Fleit & Jacobson

[57] ABSTRACT

A fastener of the kind in which a pin can be inserted into a closed housing between balls provided in a tapering space within the housing, which balls prevent the subsequent removal of the pin through the exercise of clamping action on the pin upon attempts to remove the pin from the housing, wherein the housing having a chamber housing a substantially freely rotatable body having a tapering cavity therein and a central aperture for the insertion of the pin therethrough, the cavity containing the balls, the balls having linear contact with the wall of said cavity.

5 Claims, 3 Drawing Figures

FASTENER APPARATUS

This invention relates to a fastener which comprises a closed housing having an aperture therein, a tapering space within said housing, a plurality of balls within said tapering space, and a pin that can be inserted through said aperture into said housing between said balls in the tapering space, which prevent the removal of said pin by being jammed in said tapering space, and thereby exercising clamping action on said pin, upon attempts to remove the pin from the housing.

Such a fastener can be used, for example, for tagging clothing in a shop with a detection plate containing an electrical circuit adapted to be detected in a detection zone. Such detection plates will normally be removed by a shop assistant by means of a special apparatus if a piece of clothing has been paid for by the customer. If, therefore, a detection plate is detected in the detection zone, located in the vicinity of the exit of the shop, this means that someone tries to leave the shop with unpaid goods.

In the application described, the pin is inserted through the fabric of a piece of clothing into the housing of the fastener, which housing preferably is formed integrally with the detection plate. It is therefore of paramount importance that the pin can only be removed by means of the special apparatus, which comprises a strong magnet preferably an electromagnet for pulling the balls clear of the pin.

Fasteners of the above type are described in the published Dutch patent applications Nos. 71,01103 and 73,06201.

A drawback of these prior devices is that, upon attempts at removing the pin, which has a smooth surface, with a twisting movement, the balls will roll along the pin and the inner wall of the conical housing and thus may form a groove in the pin. This tends to weaken the pin and also to render it unfit for re-use with clothing made of thinner fabrics. Furthermore, with the prior device there is the danger that the pin can actually be turned out of the housing with a twisting movement.

In order to remedy this danger, it has been proposed in German Offenlegungsschrift No. 2,548,546 to make the housing of the fastener rotatable on the detection plate, so that the housing will rotate along with the pin. In that construction, however, the area of surface-to-surface friction between the housing and the detection plate is so large that, upon the exercise of a twisting and pulling movement, it is not the housing that will rotate, but the balls, so that, in this case, too, there is the chance that the pin is turned out of the fastener with a twisting movement.

It is an object of the present invention to remedy the drawbacks and disadvantages outlined above.

According to the present invention a fastener of the kind described is characterized by a chamber within the housing, which chamber houses a substantially freely rotatable body having a tapering cavity therein and a central aperture for the insertion of the pin therethrough, and containing the balls, said balls having linear contact with the wall of said cavity.

Some embodiments of the present invention will now be described, by way of example, with reference to the accompanying drawings. In said drawings.

Figure 1:
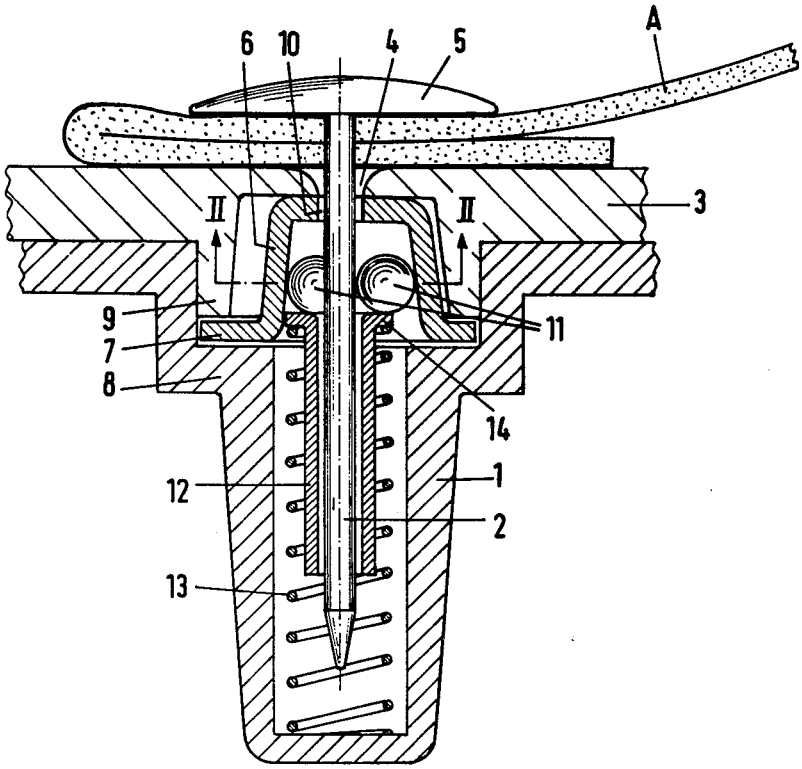
FIG. 1 is a cross-sectional view of a fastener according to the present invention.

FIG. 1 shows a fastener according to the present invention, having a housing 1, preferably made of synthetic plastics material, and of substantially cup-shaped configuration. At its open end the housing is closed with a cover 3, which may likewise be of synthetic plastics material, and has an aperture 4 therein for the insertion therethrough of a pin 2, preferably made of steel. When used in an anti-theft system, the cover may have an extension in the form of a plate in which an electrical circuit is embedded. This plate is not shown in the accompanying drawings, as it does not, by itself, form part of the present invention. Furthermore this plate or the cover 3 or the housing 1 may have a flexible extension in which the head of the pin may be embedded, so as to retain the pin when it is loosened.

Pin 2 can be inserted through an article A to be safeguarded and through aperture 4 into housing 1, the article being retained between the head 5 of pin 2 and cover 3 of housing 1. In manufacture, the cover and the housing are indissolubly joined after the assembly of the various components of the fastener, which will be further described hereinafter.

Provided in housing 1 is a cap member 6 having a tapering cavity whose cross-sectional configuration is triangular with rounded corners. In this embodiment the cap has the same general outside configuration, but this need not necessarily be the case. The end of the cap away from cover 3 is open, and has a flat peripheral flange or rim 7, disposed between a land 8 of the housing and an annular skirt 9 of cover 3. The end of cap 6 facing cover 3 is closed except for a central aperture 10 in registry with aperture 4 in the cover.

Housed within the tapering cavity of cap 6 are three balls 11, urged into the direction of cover 3 by a spring-loaded thrust member 12. Spring pressure is provided by a helical spring 13, extending in housing 1 and bearing at one end against the bottom of the housing and at the other against a collar 14 of thrust member 12. Thrust member 12 has a central bore for receiving pin 2.

The operation of the device is as follows. Pin 2 is inserted through the material of an article to be safeguarded, or through an aperture already present therein, into the central aperture of the lock. As the pin is inserted into the lock, balls 11, along with thrust member 12, are pushed back (in the drawing, downwards) against the pressure of spring 13 to such an extent that the pin can pass between the balls and be pushed home into the lock.

This situation is shown in FIG. 1. If it is now tried to remove the pin with a pulling force, the balls will be jammed fast between the walls of cap 6 and the pin, and the resulting frictional force will prevent the pin from being removed. If it is attempted to remove the pin with a twisting movement, the cap will rotate along, so that the pin cannot be removed either. As a matter of fact a relatively strong frictional force is operative between the balls and the cap, owing to the cavity of the cap being shaped at the corners to match the circumference of the balls (see FIG. 2). The cap has, on the other hand, only a small area of contact with the inner wall of the housing, in the present case with the cover only. The pin can accordingly only be removed when the thrust member is retracted by magnetic means.

An additional advantage of the construction described is that owing to the rounded corners of the tapering cavity in the cap member, the pressure of the balls against the wall of the cap member is relatively slight, so that it is not necessary for the cap member to be made of hard material to prevent deformation. Furthermore, the forces occurring when attempts are made at unauthorized removal of the pin are taken up by the straight wall portions intermediate the rounded corners, so that no bending forces are generated in these wall portions, as would be the case when the cap has a circular cross-section, as in prior constructions.

Figure 2:
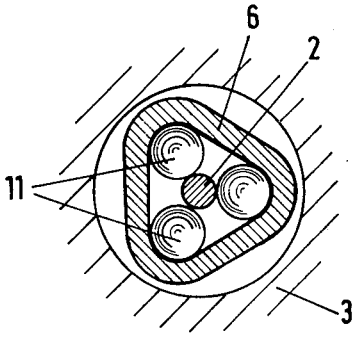
FIG. 2 shows a sectional view, taken on the line II—II of FIG. 1.
Figure 3:
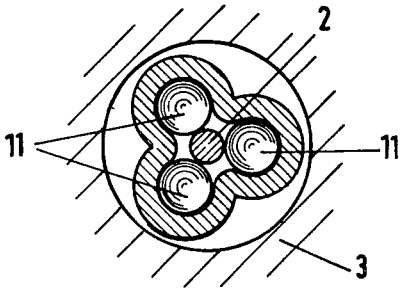
FIG. 3 is a view similar to FIG. 2, but showing a different embodiment.

FIG. 3 shows a different embodiment of the cap member, in which the friction between the balls and the wall of the cap is still greater than in the construction of FIG. 2, in that the tapering cavity of the cap is of trefoil cross-section to provide in fact three compartments embracing the balls over a larger portion of their circumference.

It will be clear that various modifications and changes can be made without departing from the scope of the present invention. Thus a different number of balls may be used, with the cavity in the cap member being shaped accordingly. Also, this invention is obviously not limited to the use of the device in the context of anti-theft systems. Other uses will readily occur to those skilled in the art, and should be considered to be within the scope of the invention.

I claim:

1. A fastener of the kind in which a pin can be inserted into a closed housing between balls provided in a tapering space within said housing, the closed housing including biasing means for urging the balls into contact with an inserted pin so that the balls prevent the subsequent removal of said pin through the exercise of clamping action on said pin upon attempts to remove the pin from the housing, characterized by said housing having a chamber therein, and by the tapering space being defined by a substantially freely rotatable body housed in said chamber, said rotatable body having a tapering cavity therein defining the tapering space and a central aperture for the insertion of the pin therethrough, said tapering cavity containing the balls, said balls being enclosed within said rotatable body and having linear contact with the wall of said tapering cavity, said chamber of said housing having a wall thereof defined by an internal shoulder of the housing, said housing being closed by a cover having a central aperture aligned with said central aperture of said freely rotatable body for the insertion of the pin and a shoulder positionably spaced from the internal shoulder of the housing, said rotatable body being cap-shaped and having an outwardly projecting flange loosely held between the internal shoulder of the housing and the shoulder of the cover so that said rotatable body is rotatable with respect to said housing and said cover.

2. A fastener according to claim 1, wherein the cavity of the freely rotatable body has, in cross-section, rounded corner portions having the same radius as the balls.

3. A fastener according to claim 1 or 2, wherein the cavity of the freely rotatable body is triangular in cross-section with rounded corners.

4. A fastener according to claim 1 or 2, wherein the cavity of the freely rotatable body is of trefoil shape in cross-section.

5. A fastener according to claim 1 or 2, wherein the cavity of the freely rotatable body is in cross-section similar to the cross-sectional configuration of the entire body.

* * * * *